US007271358B2

(12) United States Patent
Ulfik et al.

(10) Patent No.: US 7,271,358 B2
(45) Date of Patent: Sep. 18, 2007

(54) SWITCHING HINGE

(75) Inventors: Joachim Ulfik, Vlotho (DE); Markus Finger, Minden (DE); Lothar Pedron, Wenden (DE)

(73) Assignee: Bernstein AG, Porta Westfalica (DE)

( * ) Notice: Subject to any disclaimer, the term of this patent is extended or adjusted under 35 U.S.C. 154(b) by 0 days.

(21) Appl. No.: 11/526,024

(22) Filed: Sep. 25, 2006

(65) Prior Publication Data

US 2007/0068780 A1 Mar. 29, 2007

(30) Foreign Application Priority Data

Sep. 26, 2005 (DE) ..... 10 2005 046 083

(51) Int. Cl.
*H01H 3/16* (2006.01)

(52) U.S. Cl. ..... 200/61.7; 200/61.62

(58) Field of Classification Search ..... 200/61.7
See application file for complete search history.

(56) References Cited

U.S. PATENT DOCUMENTS 3,729,603 A * 4/1973 Foltz ..... 200/61.7
3,803,375 A * 4/1974 Foltz ..... 200/61.7
4,922,064 A * 5/1990 Price et al. ..... 200/61.7
5,717,380 A * 2/1998 Zehrung ..... 340/545.7

FOREIGN PATENT DOCUMENTS

GB 1 279 381 6/1972

* cited by examiner

*Primary Examiner*—Elvin Enad
*Assistant Examiner*—Lheiren Mae A. Anglo
(74) *Attorney, Agent, or Firm*—Barnes & Thornburg LLP

(57) ABSTRACT

A switching hinge comprises a hinge housing (6) at which a hinge flap (4) is swivellably disposed, a switching element (2) coupled with the hinge flap (4) being provided, which switching element (2) triggers a switching operation at a built-in switch (7) in a predetermined position of the hinge flap (4). According to the invention, the built-in switch (7) can be adjusted relative to the switching element (2) for adjusting the switching point. Particularly, a precision adjustment can be carried out so that an adaptation to the respective installation situation becomes possible.

10 Claims, 3 Drawing Sheets

SWITCHING HINGE

BACKGROUND AND SUMMARY

The present invention relates to a switching hinge including a hinge housing on which a hinge flap is swivellably disposed. A switching element is coupled to the hinge flap, which switching element triggers a switching operation at a built-in switch in a predetermined position of the hinge flap. The built-in switch is adjustable relative to the switching element to adjust a switch point at which the switching operation occurs.

Switching hinges exist where a switching element is coupled with a hinge flap, so that a switching operation is triggered in a certain position of the hinge flap relative to the hinge housing. Once the switching hinge is mounted on a corresponding component, such as a safety door, etc., the switching point can no longer be changed. Specifically when diverse components are assembled and disassembled for transport, an adaptation to a respective installation situation may be required in order to avoid malfunctioning.

From British Patent Document GB 1 279 381, a switching hinge is known which has a switching element for triggering a switching operation at a certain angular position of a hinge. In this case, the switching element is accommodated as a separate component in the hinge and can be adjusted by a screw for setting the switching point.

The present disclosure relates to a switching hinge which has a simple construction, can be adapted to a respective installation situation and the switching point can be adjusted.

According to the present disclosure, a switching hinge comprises a hinge housing that includes a hinge flap swivellably disposed on the hinge housing. The switching hinges also includes a switch housing having a built-in switch. A switching element is coupled to the hinge flap, which hinge flap triggers a switching operation at the built-in switch in a predetermined position of the hinge flap. The built-in switch is adjustable relative to the switching element for adjusting a switching point at which the switching operation occurs. The built-in switch is held on a film hinge, the film hinge being constructed integrally with the switch housing.

According to the present disclosure, the built-in switch can be adjusted relative to the switching element for adjusting the switching point, so that a triggering of the built-in switch can be adapted to the respective installation situation. In particular, the built-in switch can remain in the mounted position, and the switching point is reached by a corresponding adjustment. For a constructively simple solution, the built-in switch is held on a film hinge which is constructed integrally with the switch housing. Although the built-in switch will then be securely held in the switch housing, it can be swivelled in a simple manner, if required.

According to an embodiment of the present disclosure, the built-in switch is accommodated in a switch housing, and the position of the built-in switch in the switch housing can be changed by adjusting devices. The built-in switch can be arranged to be swivellable about an axis in order to be able to carry out a corresponding precision adjustment.

An adjusting screw is provided for adjusting the built-in switch, so that a continuous adjustment can be carried out. The built-in switch can be adjusted in opposite directions inside the switch housing, so that an adaptation of the switching point can be carried out in both directions. The adjusting range may be limited by stops. As a result, it can be ensured that the precision adjustment can take place only within the range of the necessary or required separation of the respective or chosen built-in switch that is used. That precision adjustment can be, for example, only within a few degrees.

According to an embodiment of the present disclosure, openings for adjusting the adjusting screw are provided at the switch housing. Thus, when the switching hinge is mounted, a corresponding adjustment can be carried out in a simple manner.

In order to be able to estimate the extent of the adjustment, markings may be provided on the switch housing for indicating an adjusting path.

Other aspects of the present disclosure will become apparent from the following descriptions when considered in conjunction with the accompanying drawings.

DETAILED DESCRIPTION

Figure 1:
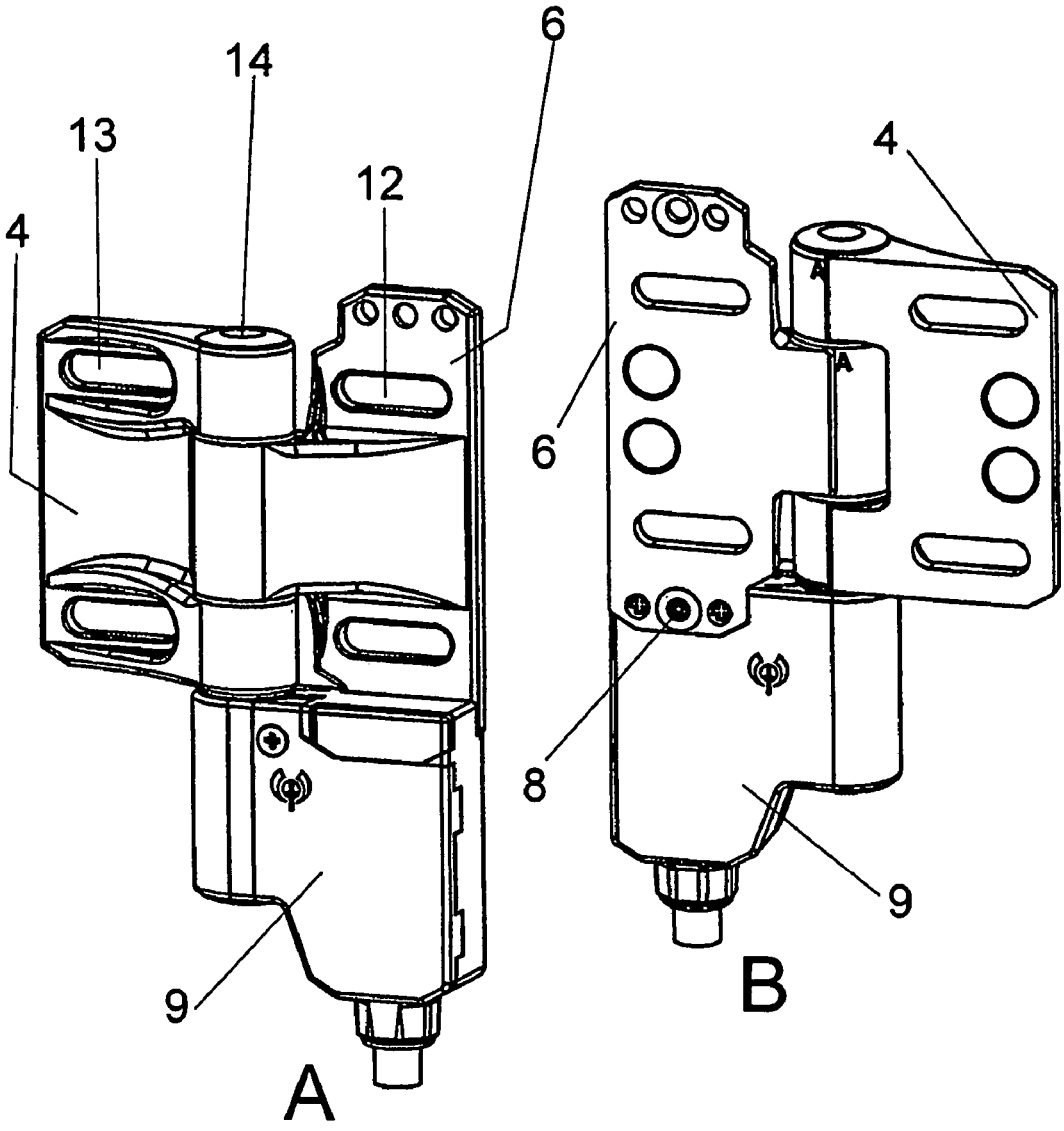
FIGS. 1A and 1B are two perspective views of a switching hinge, according to the present disclosure.

A switching hinge comprises a hinge housing 6 at which a hinge flap 4 is rotatably fixed. By at least one screw 8, a switch housing 9 is mounted to the hinge housing 6. In the switch housing 9, a built-in switch 7 is arranged which triggers a switching operation at a certain angular position of the hinge flap 4 relative to the hinge housing 6. The hinge housing 6 is provided with slots 12, whereby the hinge housing 6 can be mounted on a component (not shown). Slots 13 for a connection with another component (not shown) are provided on the hinge flap 4.

Figure 2:
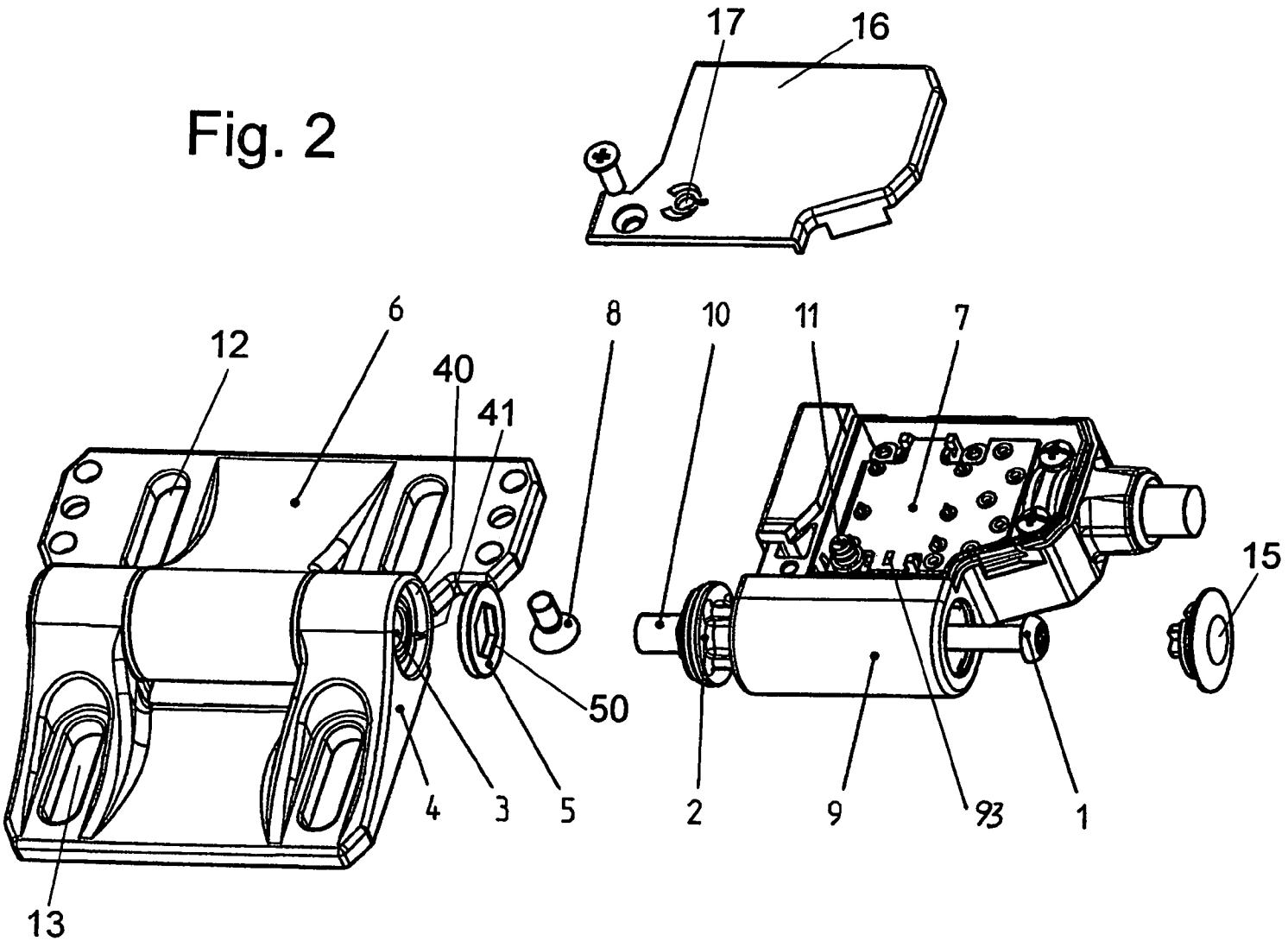
FIG. 2 is an exploded view of the switching hinge of FIGS. 1A and 1B.

As illustrated in FIG. 2, a screw 1 penetrates a switching element 2 in the form of a switching cylinder. By a switching element guide 10 in the form of a cylindrical pin, the switching element 2 is inserted into a receiving device 3 which is arranged concentrically with respect to an axis of rotation R of the hinge flap 4. The switching element 2 interacts with built-in switch 7 in order to trigger a switching operation at a certain angular position of the switching element 2.

For a non-rotatable coupling of the switching element 2 with the hinge flap 4, a connection element 5 is provided on a ring-shaped plastic disk which has a circular outer circumference. The connection element 5 can be clampingly inserted into a receiving device 40 at the hinge flap 4. There is at least one inwardly protruding tooth 41 projecting at the receiving device 40. The connection element 5 is form-lockingly pressed into the receiving device 40, so that a non-rotatable connection is established between the connection element 5 and the hinge flap 4.

An opening 50 in the form of a hexagon is constructed in the connection element 5, and a corresponding hexagonal pin at the switching element 2 engages in the opening 50.

When the hinge flap 4 is swivelled together with a component, a relative movement takes place between the hinge flap 4 and the hinge housing 6. This rotating motion is transmitted by way of the connection element 5 and the switching element 2 until, at a certain angular position, a spring-loaded displaceable contact pin 18, acting at the switching element 2, engages in a receiving device or recess in switching element 2 and form-lockingly actuates electric contacts. As a result, an electric connection is opened or closed at the built-in switch 7. A particular position of the connection element 5 establishes a desired switching point at which a switching operation takes place.

When a user wants to define another desired switching point at the switching hinge, a covering cap 15 can first be removed from the switch housing 9 in order to release the screw 1. Then, the countersunk screw 8 is removed, so that the switch housing 9 can be swivelled and can be demounted from the hinge housing 6. Then the desired switching point can be newly set by exchanging or rotating the connection element 5. An adaptation to a respective built-in situation is thus possible.

Figure 3:
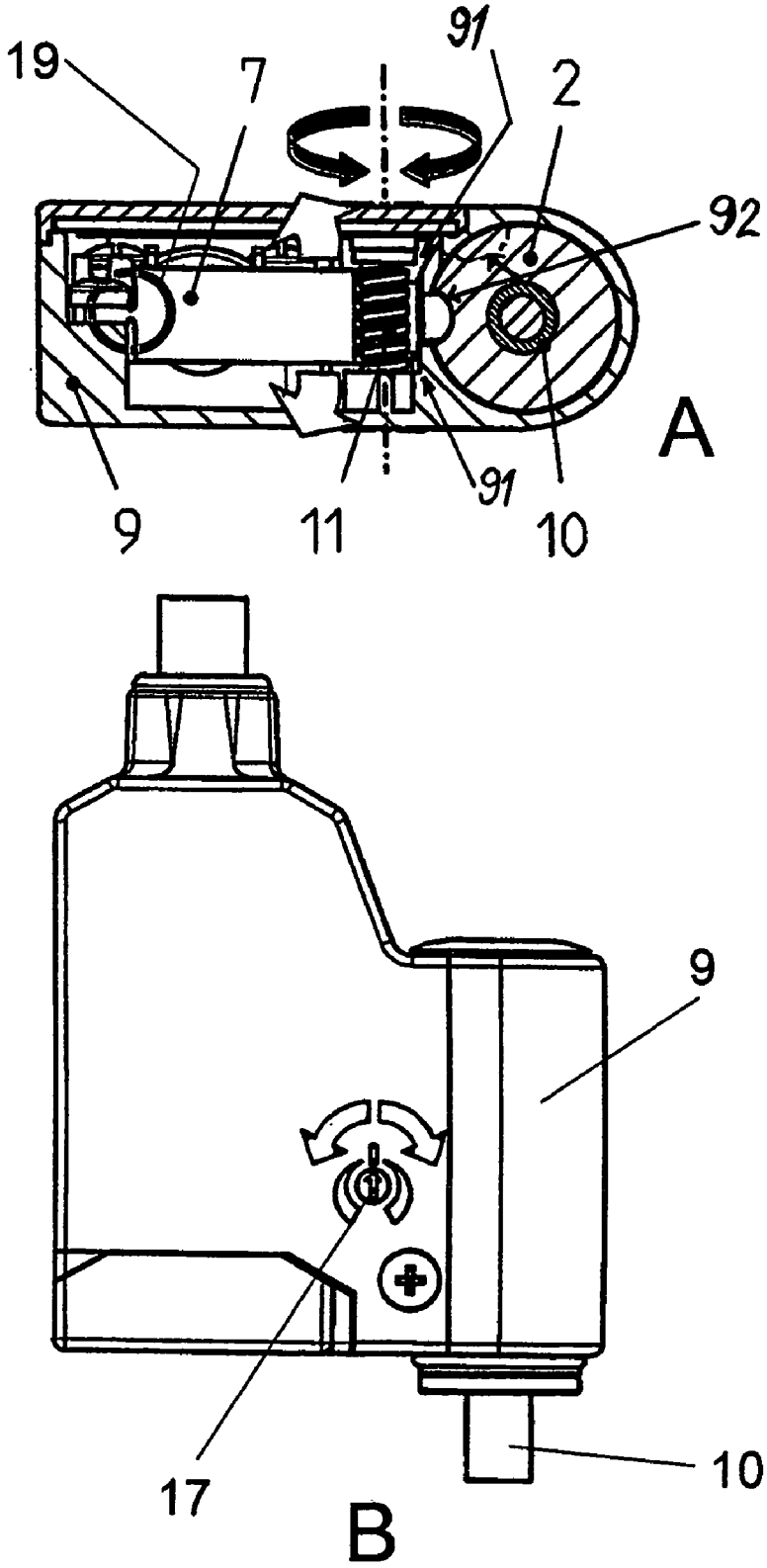
FIG. 3A is top, partial cross-sectional view of the switch housing of the switching hinge of FIGS. 1A and 1B
FIG. 3B is a side view of the switch housing of the switching hinge of FIGS. 1A and 1B.

As shown in FIGS. 3A and 3B, it is possible to carry out a precision adjustment after a rough adjustment of the desired switching point has taken place. An adjusting screw 11 is provided in the switch housing 9, which adjusting screw 11 is accessible from a top side as well as from a bottom side of the switch housing 9 by way of an opening 17. By the adjusting screw 11 (see arrows 10 in FIG. 3A), the built-in switch 7 can be swivelled on a pivot 19, as suggested by the two arrows 70 in FIG. 3A. The pivot 19 is constructed as a film hinge, which is constructed integrally with the switch housing 9.

By the swivelling motion of the built-in switch 7, spring-loaded contact pin or key 18 is moved slightly from a center position in an upward or downward direction, so that its position is changed relative to the switching element 2. At the switching element 2, a recess 92 is provided at an outer circumference, into which recess 92 the spring-loaded key 18 engages for triggering a switching operation. In a certain area, the position of the key 18 can therefore be changed by adjusting screw 11, so that the switching point is changed, which is the result of an interaction of the key 18 with the switching element 2.

The precision adjustment is limited by stops 91 within the switch housing 9. As a result, the adjusting range, shown by markings 171 in FIG. 3B, can be limited such that an adjustment can take place only within the range of the necessary separation of the built-in switch 7. Sufficient security therefore exists with respect to manipulation from the outside, because the adjusting possibility from the outside concerns no safety-relevant adjustment and the stops cannot be changed from the outside. Furthermore, it is conceivable to be able to change the position of the switching element 2 by adjusting devices relative to the built-in switch 7 instead of adjusting the built-in switch 7.

In an embodiment of the present disclosure, the connection element 5 is exchangeably fixed in a receiving device 40 of the hinge flap 4. It is conceivable to provide a projecting pin, for example, tooth 41 at the hinge flap 4 and to construct the receiving device 40 at the switching element 2. Furthermore, other fastening devices can also be provided in order to achieve a non-rotatable connection between the switching element 2 and the hinge flap 4.

Several recesses 92 (see FIG. 3A showing an additional recess 92 in phantom) contacts may be provided at the switching element 2 in order to be able to utilize a corresponding number of desired switching points. Furthermore, it is conceivable to provide electronic or magnetic sensors 93 at the switching element 2, by which a detection of the angular position of the hinge flap 4 can be carried out.

In an embodiment according to the present disclosure, the built-in switch 7 is accommodated in a switch housing 9 which is fixed to the hinge housing 6. However, it is conceivable to arrange the built-in switch 7 in a modification of hinge housing 6 in order to implement a particularly compact construction, so that the switch housing 9 will not be necessary.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A switching hinge, comprising:

a hinge housing including a hinge flap swivellably disposed on the hinge housing;

a switch housing including a built-in switch;

a switching element coupled to the hinge flap, which hinge flap triggers a switching operation at the built-in switch in a predetermined position of the hinge flap;

the built-in switch being adjustable relative to the switching element for adjusting a switching point at which the switching operation occurs;

the built-in switch is held on a film hinge, the film hinge being constructed integrally with the switch housing; and wherein the built-in switch is configured to be adjusted in opposite directions within the switch housing.

2. The switching hinge according to claim 1, wherein the built-in switch is accommodated in a switch housing, and a position of the built-in switch in the switch housing can be changed by adjusting devices.

3. The switching hinge according to claim 1, wherein the built-in switch is swivellable about an axis.

4. The switching hinge according to claim 1, wherein a position of the built-in switch is adjustable by an adjusting screw.

5. The switching hinge according to claim 1, wherein an adjusting range of the built-in switch is limited by stops.

6. The switching hinge according to claim 5, wherein the adjusting range is limited such that the adjusting range is in a range of the necessary separation of the built-in switch that is used.

7. The switching hinge according to claim 1, wherein openings to adjust the adjusting screw are provided at the switch housing.

8. A switching hinge, comprising:

a hinge housing including a hinge flap swivellably disposed on the hinge housing;

a switch housing including a built-in switch;

a switching element coupled to the hinge flap, which hinge flap triggers a switching operation at the built-in switch in a predetermined position of the hinge flap;

the built-in switch being adjustable relative to the switching element for adjusting a switching point at which the switching operation occurs;

the built-in switch is held on a film hinge, the film hinge being constructed integrally with the switch housing; and wherein markings to indicate an adjusting path are provided at the switch housing.

9. A switching hinge, comprising:

a hinge housing including a hinge flap swivellably disposed on the hinge housing;

a switch housing including a built-in switch;

a switching element coupled to the hinge flap, which hinge flap triggers a switching operation at the built-in switch in a predetermined position of the hinge flap;

the built-in switch being adjustable relative to the switching element for adjusting a switching point at which the switching operation occurs;

the built-in switch is held on a film hinge, the film hinge being constructed integrally with the switch housing; and wherein several contacts are provided to permit different switching points, and by a rotating motion of the hinge flap, the different switching points are triggered in a respective angular position.

10. The switching hinge according to claim 9, wherein sensors to detect the respective angular position are provided at the switching element.

* * * * *